US007201011B2

(12) United States Patent
MacDonald et al.

(10) Patent No.: US 7,201,011 B2
(45) Date of Patent: Apr. 10, 2007

(54) INTEGRATED NOISE AND HEAT MANAGEMENT SYSTEM

(75) Inventors: Roderick John MacDonald, Okotoks (CA); Colin David McMaster, Stettler (CA); Clifford Charles Faszer, Calgary (CA); Andrew Clifford Faszer, Calgary (CA)

(73) Assignee: Noise Solutions Inc., Calgary, Alberta (CA)

( * ) Notice: Subject to any disclaimer, the term of this patent is extended or adjusted under 35 U.S.C. 154(b) by 182 days.

(21) Appl. No.: 11/061,092

(22) Filed: Feb. 18, 2005

(65) Prior Publication Data

US 2005/0188712 A1 Sep. 1, 2005

Related U.S. Application Data

(60) Provisional application No. 60/545,936, filed on Feb. 20, 2004.

(51) Int. Cl.
*F25D 23/12* (2006.01)

(52) U.S. Cl. ..... 62/259.1; 62/296

(58) Field of Classification Search ..... 62/259.1, 62/265, 296, 418, 441; 181/224, 292, 295; 52/144; 454/206
See application file for complete search history.

(56) References Cited

U.S. PATENT DOCUMENTS 1,851,762 A 1/1932 Samesreuther
1,983,056 A * 12/1934 Teichmann ..... 62/238.3
2,048,901 A * 7/1936 Vale ..... 52/92.2
2,965,412 A * 12/1960 Henderson et al. ..... 296/171
3,490,718 A 1/1970 Vary
3,967,473 A * 7/1976 Arioli et al. ..... 68/5 D
3,969,860 A * 7/1976 Bentley ..... 52/261
3,971,174 A * 7/1976 van der Lely ..... 52/79.8
3,989,415 A 11/1976 Van-Hee et al. ..... 417/312
4,128,769 A 12/1978 Bons et al. ..... 290/52
4,264,282 A * 4/1981 Crago ..... 417/243
4,385,678 A 5/1983 Cederbaum ..... 181/204
4,516,657 A 5/1985 Allard ..... 181/204
4,733,750 A 3/1988 Poirier et al. ..... 181/202
4,753,319 A 6/1988 Vinciguerra ..... 181/218
4,982,812 A * 1/1991 Hwang ..... 181/202

(Continued)

FOREIGN PATENT DOCUMENTS

FR 2333911 A * 8/1977

OTHER PUBLICATIONS

PCT International Search Report dated Jul. 14, 2005.

(Continued)

*Primary Examiner*—Mohammad M. Ali
(74) *Attorney, Agent, or Firm*—Heslin Rothenberg Farley & Mesiti P.C.; Victor A. Cardona, Esq.

(57) ABSTRACT

An integrated noise and heat management system for the management of noise and heat around a heat and noise source is described. The system includes an enclosure for surrounding the heat and noise source, the enclosure having a double wall structure defining an air space within the double wall structure. The double wall structure contains a heat exchange system in heat exchange contact with the air space and the heat source that enables the transfer of heat from the air space to the exterior of the enclosure and is doubly effective in attenuating noise from the noise source to the exterior of the enclosure.

25 Claims, 10 Drawing Sheets

U.S. PATENT DOCUMENTS

| | | | | |
|---|---|---|---|---|
| 5,170,550 | A * | 12/1992 | Cox et al. | 29/455.1 |
| 5,332,872 | A | 7/1994 | Ewanek | 181/224 |
| 5,731,687 | A | 3/1998 | Hirano et al. | 322/1 |
| 6,023,890 | A | 2/2000 | Zenobi | 52/64 |
| 6,145,616 | A * | 11/2000 | Ewanek | 181/224 |
| 6,220,523 | B1 * | 4/2001 | Fiedrich | 237/69 |
| 6,668,554 | B1 | 12/2003 | Brown | |
| 6,675,542 | B1 * | 1/2004 | Norton et al. | 52/302.1 |
| 2002/0000342 | A1 | 1/2002 | Yamada et al. | 181/204 |
| 2002/0088195 | A1 | 7/2002 | Tan et al. | 52/506.06 |
| 2003/0056960 | A1 | 3/2003 | Del Campo | |
| 2003/0126806 | A1 | 7/2003 | Ellis | 52/95 |

OTHER PUBLICATIONS

Written Opinion of the International Searching Authority dated Jul. 14, 2005.

* cited by examiner

INTEGRATED NOISE AND HEAT MANAGEMENT SYSTEM

CROSS-REFERENCE TO RELATED APPLICATIONS

This application claims the benefit of U.S. Provisional Application Ser. No. 60/545,936, filed Feb. 20, 2004, the entire disclosure of which is incorporated herein by reference.

FIELD OF THE INVENTION

An integrated noise and heat management system for the management of noise and heat around a heat and noise source is described. The system includes an enclosure for surrounding the heat and noise source, the enclosure having a double wall structure defining an air space within the double wall structure. The double wall structure contains a heat exchange system in heat exchange contact with the air space and the heat source that enables the transfer of heat from the air space to the exterior of the enclosure and that is also effective in attenuating noise between the noise source and the exterior of the enclosure.

BACKGROUND OF THE INVENTION

Gas pipeline systems that distribute natural gas through pipeline systems require a network of compressor stations to maintain the appropriate flow of gas through the pipelines. Depending on the flow requirements and the pipeline layout, compressor stations are required at various intervals and at specific locations in the pipeline system. Compressor stations are designed both to compress the gas within the pipeline as well as to remove the heat generated from compressing the gas. Gas is compressed utilizing known compressing equipment and cooling equipment. Generally, the heat of compression is managed by driving cooling air over the compression equipment and piping using large air circulation fans.

A by-product of the compression equipment and the cooling fans is that significant noise is generated by both the compression equipment and the cooling fans. In that compressor stations may be located in both relatively isolated locations but also in densely populated areas, the management of noise in and around compressor stations is becoming increasingly important to comply with local laws concerning noise.

More specifically, the compressors are usually driven by a gas engine, sometimes by a turbine, and in some cases by an electric motor. The gas engine, turbines, and the compressor are very loud noise sources, often exceeding 105 dBA and in some cases up to 120 dBA. Traditionally, these loud noise sources are contained within a building that usually has very poor acoustical and ventilation properties. The large electric motors also have noise issues, primarily on the ventilation air supply and exhaust.

In the past, noise suppression for gas compression stations has been dealt with in a reactive manner following an identified noise problem. That is, a gas compression station is built and only after complaints or a clear noise problem is identified is the building modified and the cooling fan silenced to address the noise problem. This approach is both costly and inefficient because the collective issues of gas compression, heat management and noise suppression are not addressed from an integrated perspective at the time the compressor station is built.

That is, compressor stations are designed primarily to provide appropriate gas compression and heat management, but the noise issue is addressed only after the design of a station and only when due to the location of the station has noise been identified as a problem. The result is that in order to address an identified noise problem, massive and expensive noise suppression equipment is retroactively fitted to an existing compressor station. Moreover, in that most compressor stations are different both in terms of the physical dimensions of the buildings and their requirements for handling different volumes of cooling air, the retroactive approach to an identified noise issue is both complicated and inefficient given that different stations will require very different designs to retrofit noise suppression equipment.

Typically, the most costly and difficult noise source to manage is the fan noise of the very large coolers used to cool the compressed gas (and often, the engine casing's glycol/antifreeze). Common sizes of fans are fans having diameters of 4 feet to 13 feet. Typically, an 8 foot fan generally requires 20–25 HP to deliver approximately 80,000 SCFM and would be mated up with a 600 HP compressor engine. A 13 foot diameter fan would require 50–57 HP and would deliver approximately 250,000 SCFM and would be mated up with a 1400 HP engine. Significant noise levels can result from operating such equipment at these horsepower levels.

A further problem or inefficiency is that the cooler fans are usually driven by a jackshaft connected to the main compressor engine. Thus, the cooler fan is not only a major noise source but it is also utilizing power from the compressor engine, typically in the order of 4% of the energy required to run the compressor.

In some cases the fans are driven by an electric motor. The inlet and the outlet of the fan as well as the cooler's plenum walls are major noise sources that usually demand noise suppression.

In recent years, stricter environmental laws require that the oil and gas companies suppress the noise of their facilities to within permissible noise level limits.

Further still, the current practices of retrofitting compressor buildings with noise suppression equipment may result in problems of equipment overheating if the noise suppression equipment does not adequately address the issue of heat management. That is, the design of noise suppression equipment may decrease the heat transfer capabilities of the building as a whole with the result that under certain climatic or seasonal conditions, equipment will overheat requiring that operators increase ventilation within the building by opening doors with the result that noise suppression is compromised and noise will emanate from the building.

Accordingly, there has been a need for an integrated system for compressor stations that effectively addresses the need for both heat management and noise management.

In addition, there has been a need for a modular design of such a system to enable the efficient construction of such systems.

SUMMARY OF THE INVENTION

In accordance with the invention, there is provided an integrated noise and heat management system for the management of noise and heat around a heat and noise source comprising an enclosure for surrounding the heat and noise source, the enclosure having a double wall structure defining an air space within the double wall structure, the double wall structure operatively containing a heat exchange system in heat exchange contact with the air space and the heat source and wherein the double wall structure enables the transfer of heat from the air space to the exterior of the enclosure and is effective in attenuating noise from the noise source to the exterior of the enclosure.

In accordance with a further embodiment, the invention provides a modular panel for use in constructing the enclosure of an integrated noise and heat management system comprising first and second panels and a heat exchange piping system operatively connected to and supported between the first and second panels.

In a still further embodiment, the invention provides a modular system for constructing an integrated noise and heat management system comprising a plurality of modular wall and roof panels operatively containing a heat exchange piping system between inner and outer panels for interconnection with adjacent modular wall and roof panels; and, a plurality of connectors for connecting the wall and roof panels together.

BRIEF DESCRIPTION OF THE DRAWINGS

The invention is described with reference to the following drawings wherein.

DETAILED DESCRIPTION OF THE INVENTION

Figure 1:
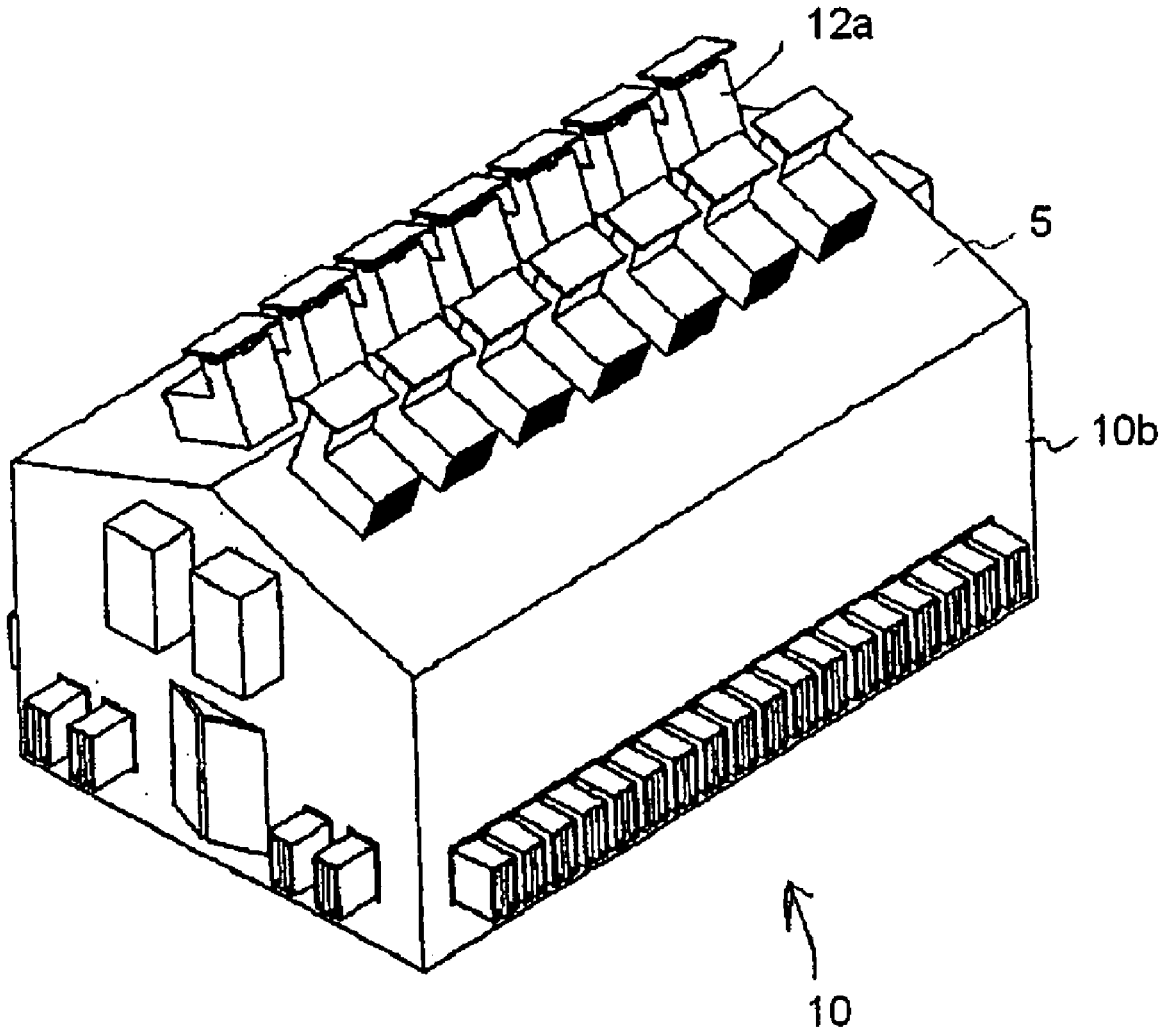
FIG. 1 is an isometric view of an integrated heat and management system in accordance with one embodiment of the invention.

With reference to the Figures, an integrated heat and noise management system 10 is described for use in facilities having a heat source and noise source that both require management. In the context of this description, the invention is described for a gas compression facility, although it is understood that the invention can be incorporated into other facilities where both heat and noise management may be required. A schematic diagram of one embodiment of a building 5 for the combined management of a heat and noise source is shown in FIG. 1.

Figure 2:
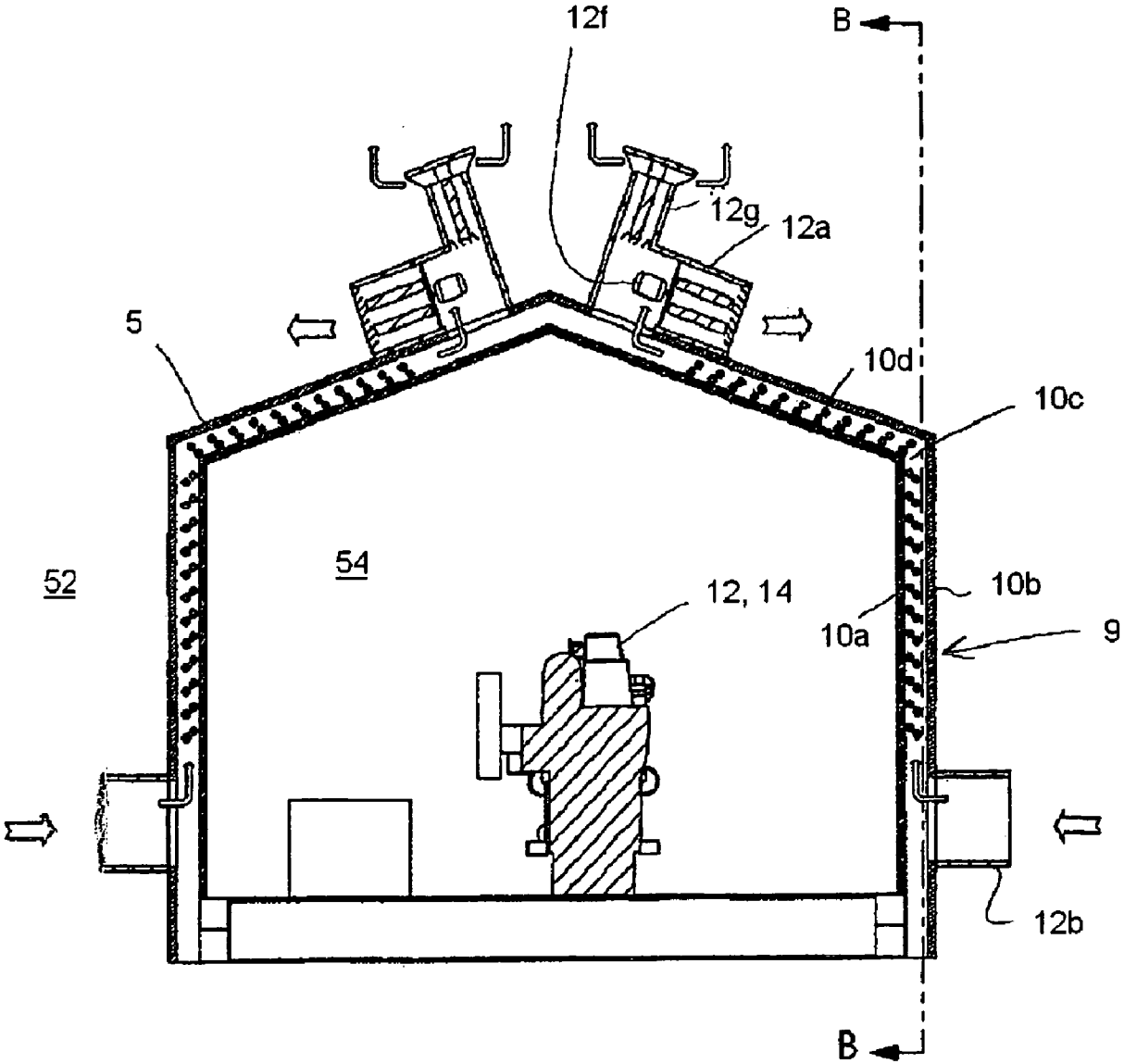
FIG. 2 is a sectional view of an integrated heat and management system in accordance with one embodiment of the invention.
Figure 3:
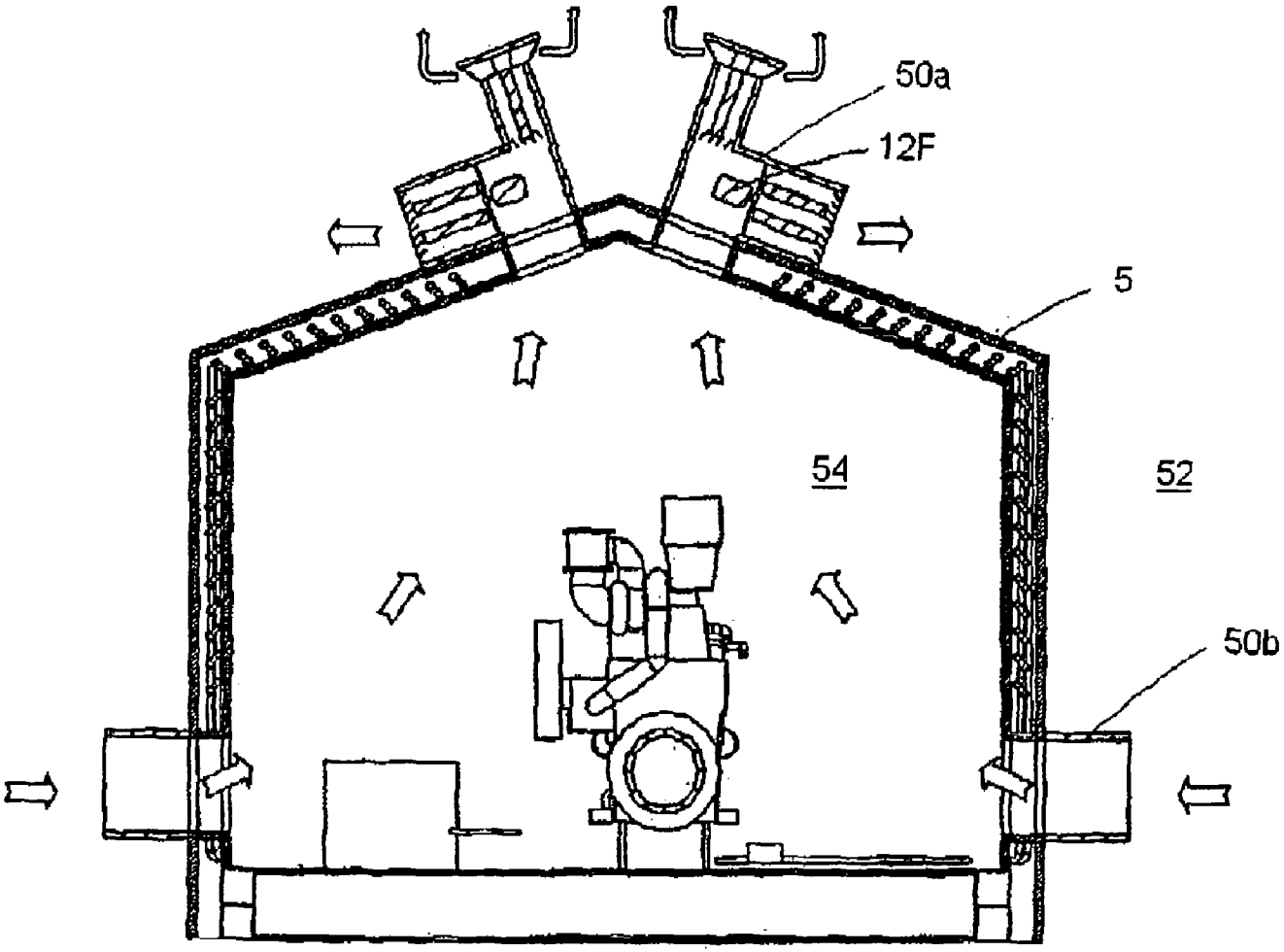
FIG. 3 is a sectional view of an integrated heat and management system in accordance with one embodiment of the invention.
Figure 4A:
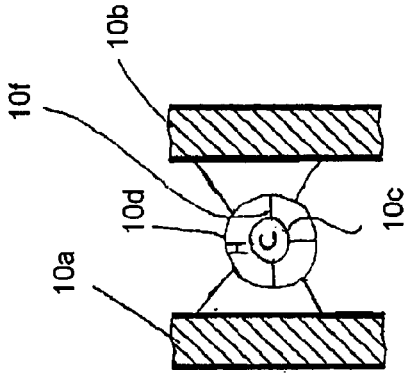
FIG. 4*a* is a schematic sectional view of the wall structure of an integrated heat and management system in accordance with one embodiment of the invention.
Figure 4:
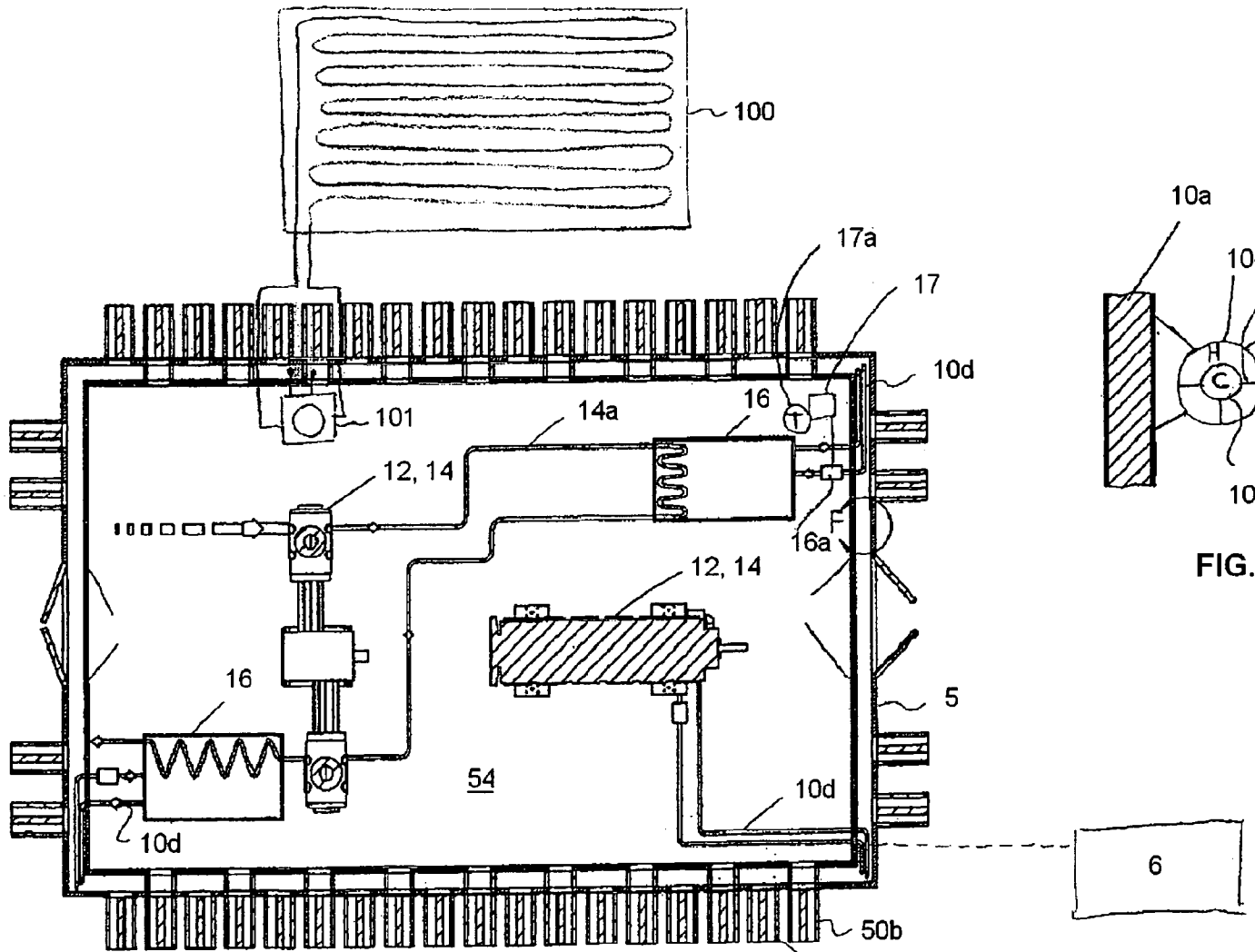
FIG. 4 is a sectional plan view of an integrated heat and management system in accordance with one embodiment of the invention.
Figure 5:
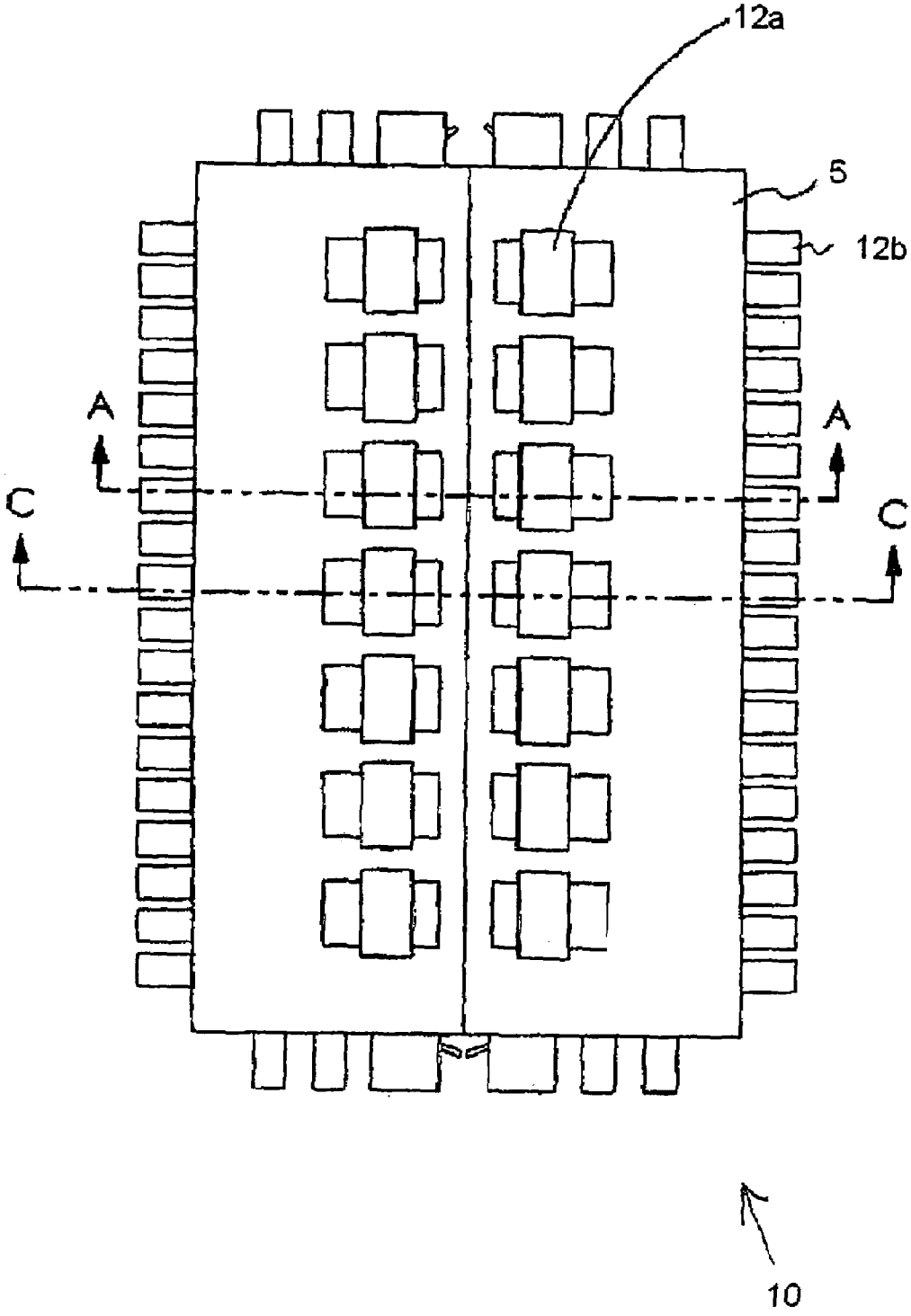
FIG. 5 is a plan view of an integrated heat and management system in accordance with one embodiment of the invention.
Figure 6:
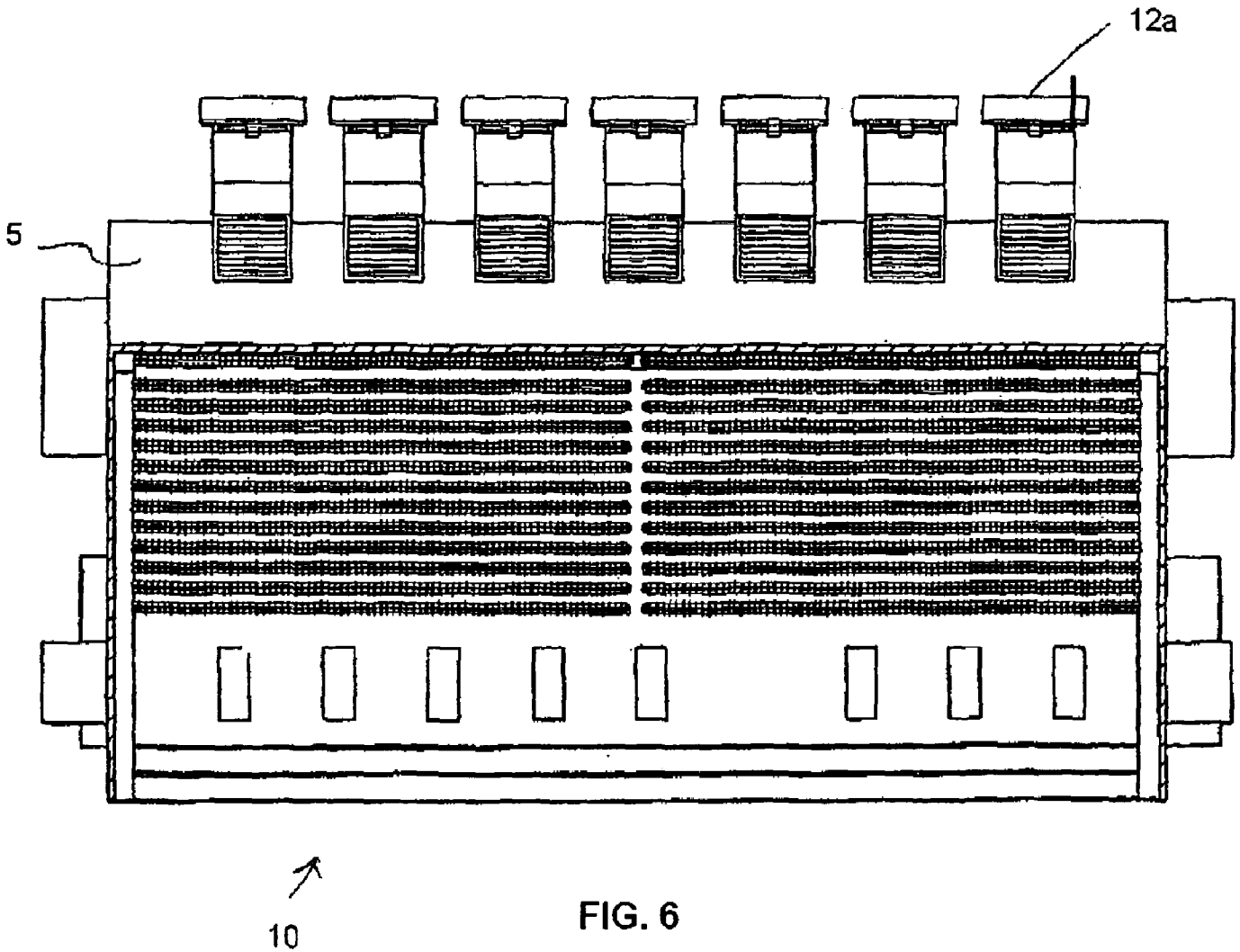
FIG. 6 is a sectional view of an integrated heat and management system in accordance with one embodiment of the invention showing cooling coils.
Figure 7:
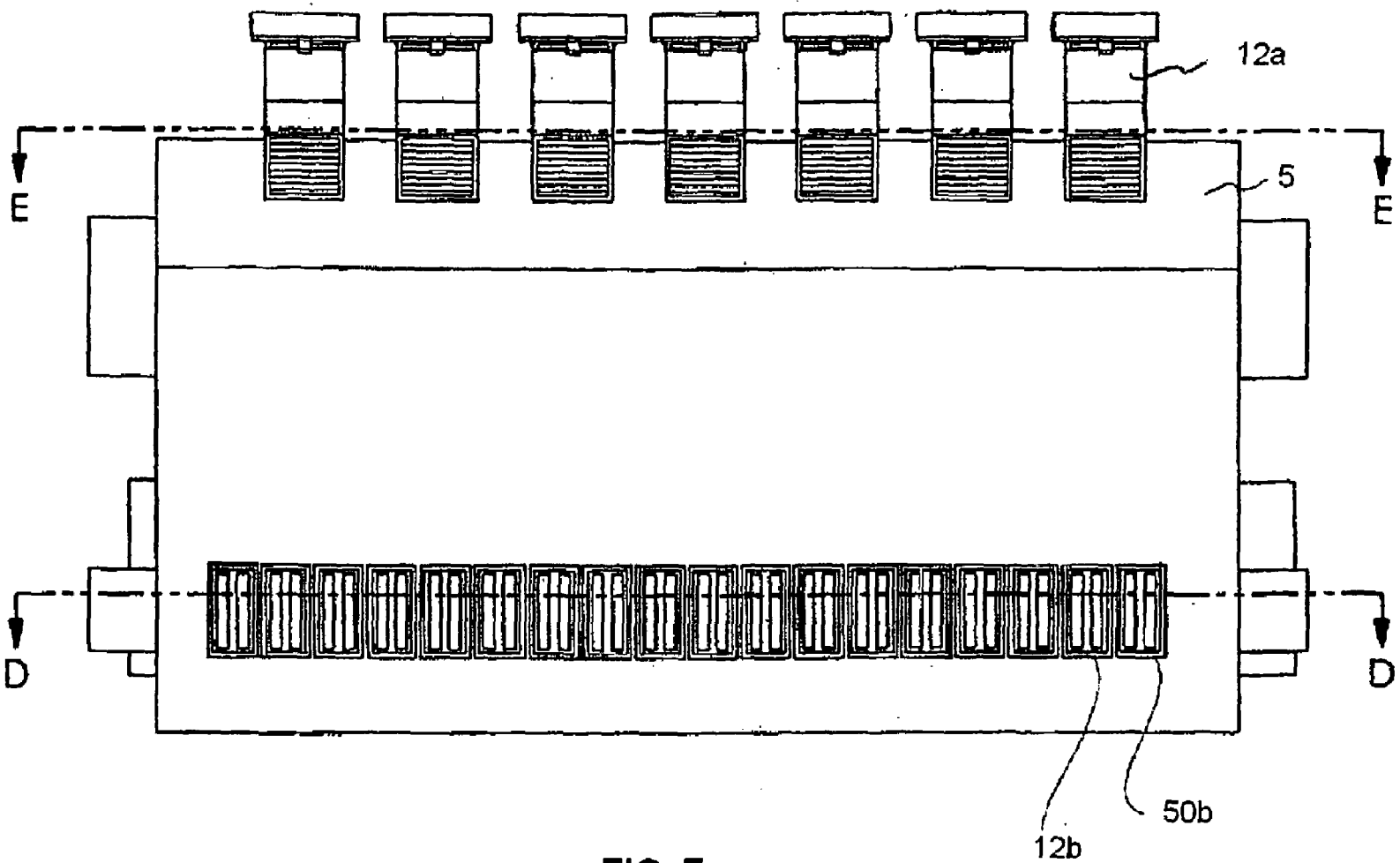
FIG. 7 is an elevation view of an integrated heat and management system in accordance with one embodiment of the invention.
Figure 8:
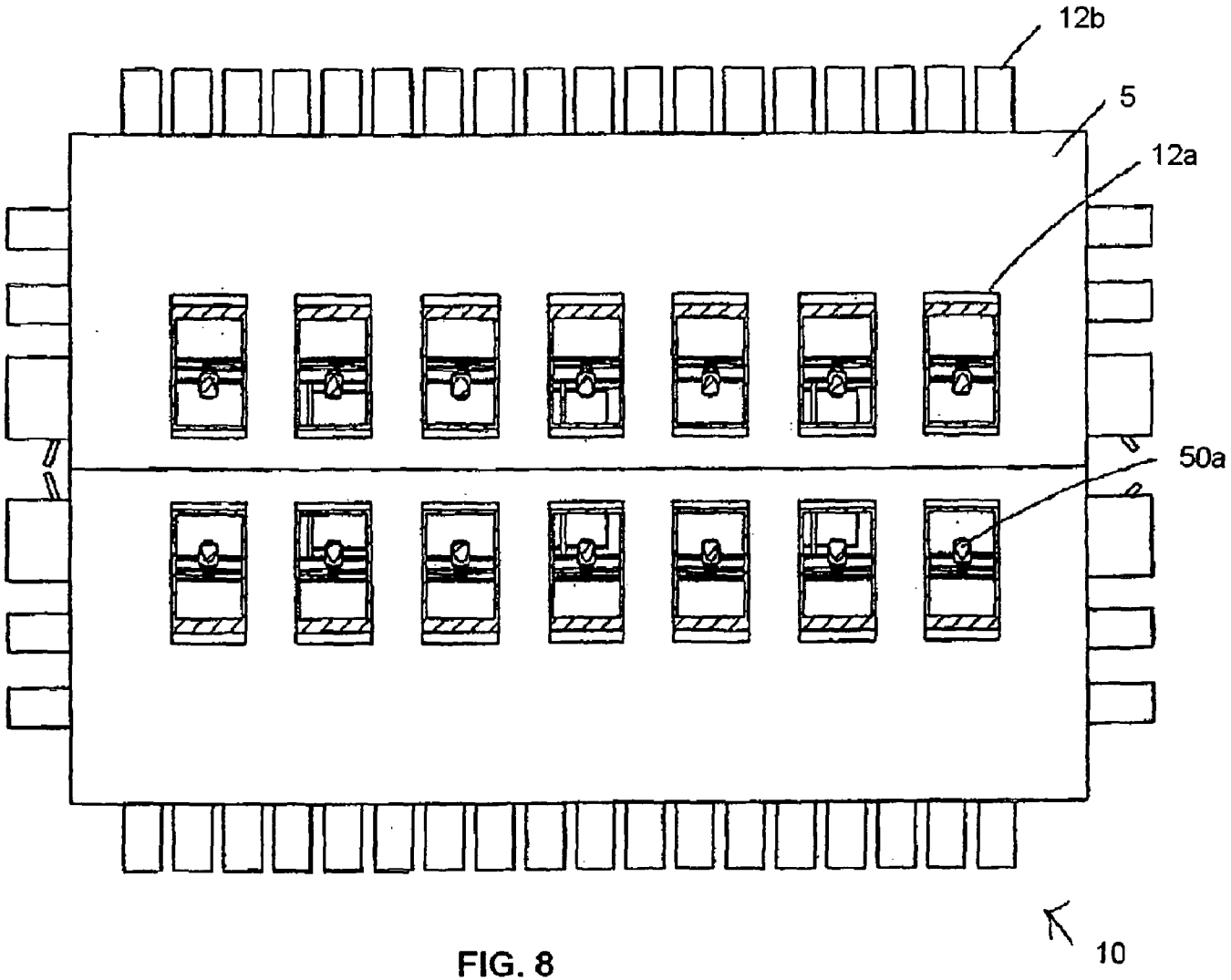
FIG. 8 is a sectional plan view of an integrated heat and management system in accordance with one embodiment of the invention.

With reference to FIGS. 2–4, the system 10 is generally integrated within the structure of a building 5 that encloses a noise 12 and heat source 14. The noise source 12 and heat source 14 generally produces sound and heat that emanate outwardly in all directions towards the interior surfaces of the building.

In accordance with the invention, the building provides a wall and roof design having a double wall structure that enables both effective noise and heat management. Specifically, the outer structures or surfaces of the building are provided with an air space 10*c* between an inner 10*a* and an outer wall 10*b* that contains piping 10*d* in heat exchange contact with the heat source and that permits heat to be effectively transferred from the air space to outside the building through a second heat exchange system. The double wall structure provides effective noise management by providing an effective combination of sound deadening surfaces and media that surround the noise source above the ground surface.

As shown best in FIG. 4, the piping 10*d* is in heat exchange contact with the heat source 14 within the building. In the example of a gas compression facility, hot compressed gas within piping 14*a*, generated by the gas compression process is passed through a first heat exchanger 16 to transfer heat to the piping 10*d* containing a fluid (preferably glycol) for circulation between the walls 10*a* and 10*b* of the building. A second heat exchange system transfers heat from the piping 10*d* to the outside of the building thus effectively removing the heat from within the building. In a preferred embodiment, the second heat exchange system is a liquid/air heat exchanger wherein air drafting through the air space 10*c* cools the piping 10*d*.

Noise suppression is effectively provided as a result of the double wall structure and the preferred incorporation of exposed acoustical insulation on either each of or both of the interior and exterior surfaces of both the inner and outer walls. The acoustical insulation may be covered by perforated metal as is known. More specifically, the double wall structure provides an interrupting air volume for sound waves propagating from within the building such that sound energy is significantly attenuated by the inner wall and almost completely eliminated by contact with the outer wall. As a result, the building as a whole provides effective noise suppression.

In one embodiment, the building also includes upper 12*a* and lower 12*b* air drafting hoods (or openings) that are in fluid communication between the air space 10*c* and the outside of the building. As shown in FIG. 2, the upper 12*a* and lower 12*b* air drafting hoods and air space 10*c* allow air outside the building to flow upwardly through the air space and over the piping 10*d*. Preferably, the heated liquid from heat exchanger 16 is introduced to the air space 10*c* in the lower regions of the wall and the roof sections so as to cause a natural upward drafting of air within the air space. The specific air and liquid flow patterns within the system may be varied as may the specific layout and orientation of piping.

The upper and lower drafting hoods may be conventional noise silencers as are known. In one embodiment, each upper drafting hood 12*a* includes a fan 12*f* to induce the movement of air upwardly through the air space. The fan may be controlled by an appropriate thermostatically controlled controller. The upper drafting hood may also include an induced draft exhaust hood 12*g*.

In one embodiment, heat may be further managed by providing upper 50*a* and lower 50*b* drafting hoods in direct communication with the interior of the building. In this embodiment, upper 50*a* and lower 50*b* drafting hoods allow air to flow directly from the exterior 52 of the building through the lower drafting hood 50*b* to the interior 54 and back to the exterior 52 of the building through the upper drafting hood 50*a* as shown in FIG. 3.

The system is preferably operated to maintain a consistent temperature within the building to enable workers to comfortably work within the building and/or to prevent equipment from overheating. In order to effectively manage the building temperature, appropriate control systems are preferably integrated within the building to control temperature that balance the heat output from the heat source and the outside air temperature. That is, during high heat production and higher outside temperatures, increased heat transfer will be required to maintain a consistent building temperature. Increased heat transfer may be controlled by increasing the flow of air through air space 10*c* by fans 12*f* or by increasing the flow rate of hot liquid within piping 10*d* by pump 16*a*. In one embodiment the system includes a thermostatic controller 17 with temperature sensor 17*a* within the building connected to pump 16*a* and/or fans 12*f* to increase or decrease the flow of liquid within the piping and/or the flow of air through the air space.

In a further embodiment, the system may incorporate an auxiliary cooling system to provide further cooling capabilities to the system. One example of an auxiliary cooling system would be a ground source cooling system 100 which may be used to provide cooling to the piping 10*d* either singly or in combination with an air cooling system. As shown in FIG. 4, a closed loop cooling system may be operatively connected to the piping 10*d* to provide cooling. In a closed loop system, a pump 101 is utilized to circulate cooling liquid within the air space 10*c*. Alternatively, an open loop ground source cooling system or other cooling source may be employed if appropriate for the location of the building.

In one embodiment as shown in FIG. 4A, the auxiliary cooling system may be integrated with the piping 10*d* as a shell and tube heat exchanger wherein cooling liquid C is contained within a central tube 10*e* and the warm liquid H from the heat exchanger 16 is contained within an outer tube 10*d*. The central tube 10*e* may be supported within the outer tube 10*d* by supports 10*f* and the outer tube may include cooling fins to both enhance the heat transfer surfaces as well as to enable connection between the inner and outer walls of the building.

The use of an auxiliary cooling system may provide improved cooling capabilities for particular installations where climatic conditions require greater cooling capabilities. In certain installations, space requirements may require smaller buildings such that an auxiliary cooling system may be required to provide adequate cooling for the particular heat transfer area available for a particular building size or for the particular heat management requirements for all seasonal, climatic and heat generation conditions. That is, an auxiliary cooling system may be required in conjunction with the air cooling system during the summer months or during any period when heat generation within the building is higher.

In one embodiment, the auxiliary cooling system may be connected directly to the heat source or to the first heat exchanger 16.

In a still further embodiment, waste heat from the building 5 may be utilized as a heat source for other applications such as providing a heating source for nearby buildings 6. In this embodiment, piping may lead directly from the heat exchanger 16 to a nearby building 6.

FIGS. 5–8 show alternate perspectives of the systems as described above.

Modular Design

In a preferred embodiment, a building 5 is constructed with modular components to enable the efficient transportation and assembly of wall and roofing sections. For example, each wall and/or roof section is preferably prefabricated with integral heat exchange piping as shown in FIGS. 9 and 9*a* which show a schematic side view and sectional top view respectively of a double walled panel containing heat exchange piping.

As shown, each modular section 60 includes heat exchange piping 10*c* fixed between two acoustical panels 10*a* and 10*b*. The piping may be fixed to one or both panels. The heat exchange piping may be comprised of a number of straight sections 10*c*' and curved sections 10*c*" as shown, assembled to form a continuous pathway within one wall panel or may incorporate an appropriate manifold (not shown). The piping within each panel may be configured to provide connection ports 66, 68 for ease of interconnection of adjacent panel sections using appropriate piping. Each piping section is supported by a spacing system 62 to create an air space between each panel 10*a* and 10*b* when assembled.

Figure 9:
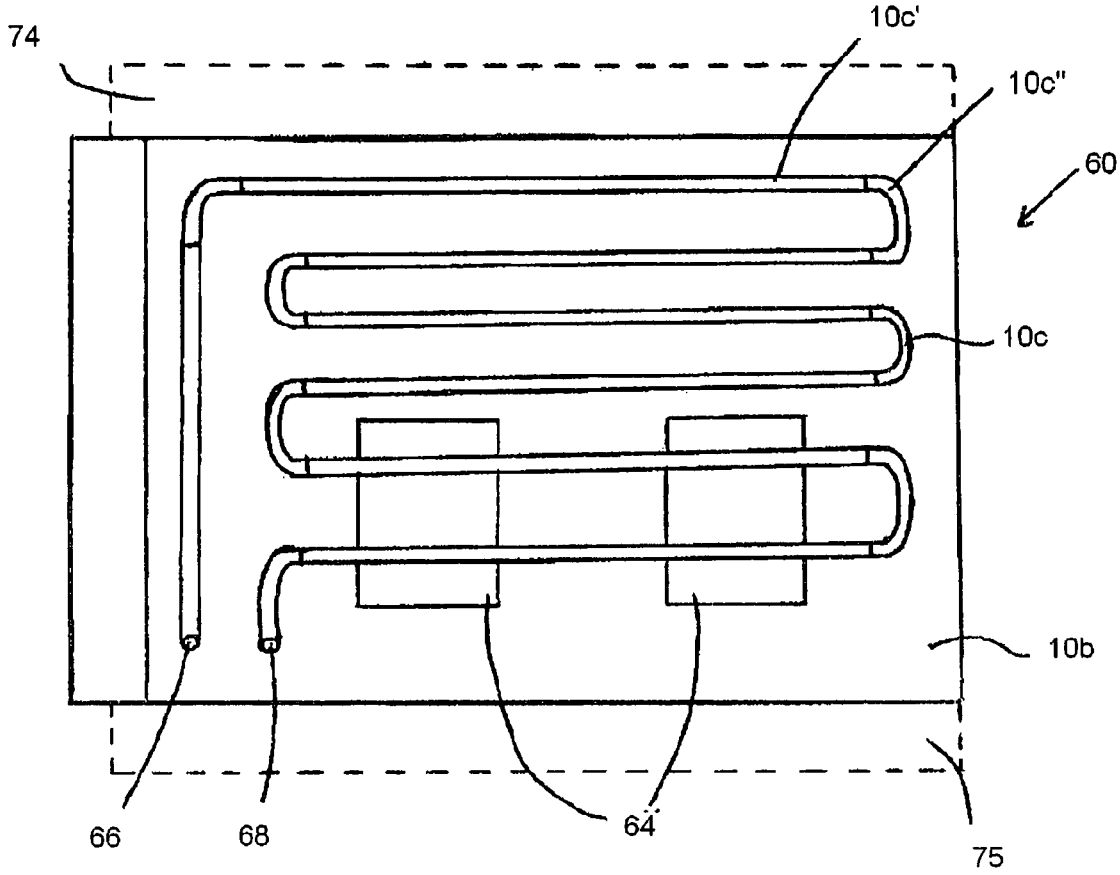
FIG. 9 is a schematic view of a modular panel in accordance with one embodiment of the invention.
Figure 9A:
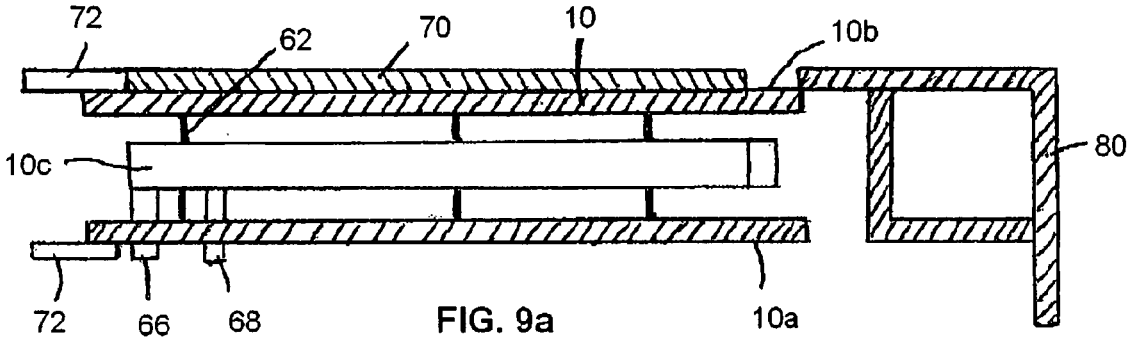
FIG. 9*a* is schematic sectional view of a modular panel and corner connector in accordance with one embodiment of the invention; and, FIG. 10 is a schematic sectional view of a wall panel and roof panel and connector in accordance with one embodiment of the invention.
Figure 10:
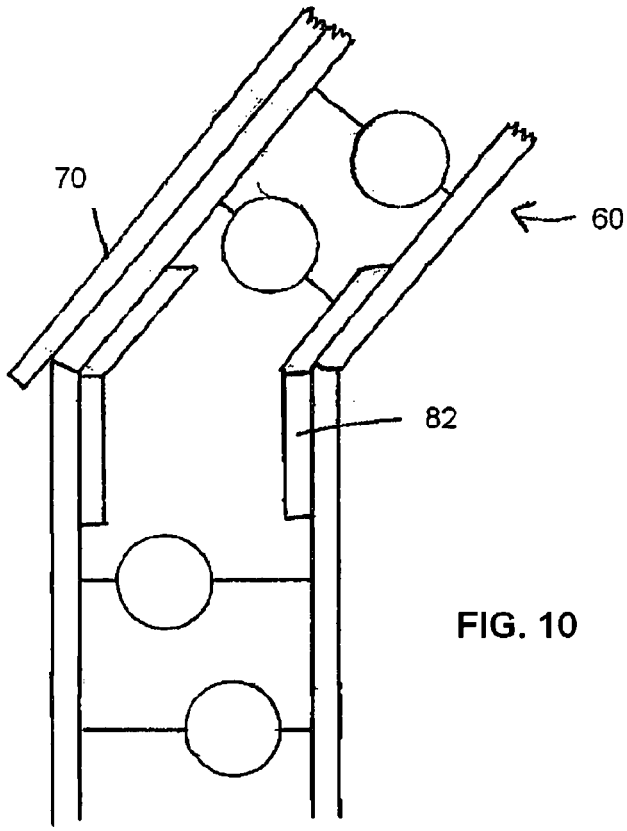

As shown in FIG. 9, the outer panel 10*b* may be provided with appropriate openings for attachment of hoods 12*a*, 12*b*, 50*a* or 50*b* to the outer surface of the building as described above.

Furthermore, the outer panel may be provided with an appropriate outer surface 70 to provide weather protection to the outer surface of the building. In yet another embodiment, each panel 60 may be provided with integral structural members 72 which may also form part of the interconnection system for adjacent panels. Appropriate header 74 or footer beams 75 may also be incorporated into each panel if desired. In another embodiment, individual panels may not include structural members such that assembled panels would be inserted between structural members of a building frame.

Roof panel sections are preferably similar to the wall panel sections with allowances made for configuration of an appropriate roofing material to the exterior of the panel.

The system may also include corner connectors 80 and roof connectors 82 to enable interconnection of adjacent wall and roofing panels.

Efficiency

The system may be operated more efficiently than conventional compressor stations in terms of infrastructure cost and operational costs while providing greater heat and noise suppression efficiency over conventional systems.

Infrastructure cost is significantly reduced by the elimination of the cooling fans and associated coolers and the structural and design components required to support large cooling fans within a building. In addition, infrastructure costs are also reduced by eliminating the requirement for retroactive design and construction of noise suppression equipment. Construction and transportation costs are also reduced by the modular design.

Operational costs are significantly reduced by the elimination of maintenance costs associated with large cooling fans and the energy requirements for running such fans.

While the system in accordance with the invention requires liquids to be pumped through the walls of the building, this energy cost is offset by the natural induction of a cooling air draft through the walls of the building.

In terms of heat management efficiency, by reducing the overall energy requirements of the building, the building will generate less heat that requires management. Moreover, the system enables the efficient use of auxiliary cooling systems such as ground source cooling systems.

In terms of noise suppression efficiency, by removing the requirement for cooling fans, the system eliminates a primary noise source within compressor stations which reduces the overall requirements for noise suppression. In addition, the system provides a design for noise suppression that fully surrounds the noise source.

It is understood that various modifications may be made to the systems as described above as may be understood by one skilled in the art without departing from the substance of the invention.

What is claimed is:

1. An integrated noise and heat management system for the management of noise and heat around a heat and noise source comprising:

an enclosure for surrounding the heat and noise source, the enclosure having a double wall structure defining an air space within the double wall structure, the double wall structure operatively containing a heat exchange system in heat exchange contact with the air space and the heat source and wherein the double wall structure enables the transfer of heat from the air space to the exterior of the enclosure and is effective in attenuating noise from the noise source to the exterior of the enclosure.

2. A system as in claim 1 wherein the double wall structure includes an inner and outer wall and each of the inner and outer wall includes acoustical insulation.

3. A system as in claim 1 wherein the heat exchange system includes piping operatively contained within the air space.

4. A system as in claim 3 wherein the piping includes fin tubes.

5. A system as in claim 3 wherein the piping includes spacers for supporting the piping within the air space.

6. A system as in claim 1 wherein the enclosure includes upper and lower drafting openings and drafting hoods operatively attached to the upper and lower drafting openings.

7. A system as in claim 6 wherein each upper drafting hood includes a fan for drafting air through the air space.

8. A system as in claim 6 wherein the drafting hoods include noise silencers.

9. A system as in claim 1 wherein the enclosure includes upper and lower drafting openings and an induced draft exhaust hood operatively attached to the upper drafting openings.

10. A system as in claim 3 further comprising a thermostatic control system operatively attached to the piping, the thermostatic control system having a temperature sensor for measuring the temperature within the enclosure, the thermostatic control system for controlling the flow of cooling liquid within the piping in response to a measured temperature within the building and/or the flow of air through the air space.

11. A system as in claim 1 further comprising an auxiliary cooling system operatively connected to the heat source.

12. A system as in claim 3 further comprising an auxiliary cooling system operatively connected to the piping.

13. A system as in claim 12 wherein the auxiliary cooling system is a shell and tube heat exchange system.

14. A system as in claim 12 wherein the auxiliary cooling system is operatively connected to a ground source cooling system.

15. A system as in claim 14 wherein the ground source cooling system is operatively connected to any one of or a combination of a closed loop or open loop cooling system.

16. A system as in claim 1 wherein the heat and noise source are gas compression equipment.

17. A modular panel for use in constructing the enclosure of an integrated noise and heat management system as in claim 1 comprising:

first and second panels; and, a heat exchange piping system operatively connected to and supported between the first and second panels.

18. A modular panel as in claim 17 further comprising a connection system for operatively connecting two modular panels to one another.

19. A modular panel as in claim 17 wherein the first panel includes a drafting opening.

20. A modular panel as in claim 17 wherein each of the first and second panels operatively supports acoustical insulation.

21. A modular panel as in claim 17 wherein the first panel includes a weather-proof surface on an outer surface.

22. A modular panel as in claim 17 wherein the heat exchange piping includes fin tubes.

23. A modular panel as in claim 17 wherein the modular panel is a roofing panel and the first panel supports a roofing surface.

24. A modular panel as in claim 17 further comprising a structural element operatively connected to at least one of the first or second panels.

25. A modular system for constructing an integrated noise and heat management system as in claim 1 comprising:

a plurality of modular wall and roof panels operatively containing a heat exchange piping system between inner and outer panels for interconnection with adjacent modular and wall and roof panels; and, a plurality of connectors for connecting the wall and roof panels together.

* * * * *